US009716951B2

(12) United States Patent
Cai et al.

(10) Patent No.: US 9,716,951 B2
(45) **Date of Patent: *Jul. 25, 2017**

(54) ACOUSTIC DIAPHRAGM AND SPEAKER BOX

(71) Applicant: AAC Technologies Pte. Ltd., Singapore (SG)

(72) Inventors: Bin Cai, Shenzhen (CN); YunXia Xu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 14/928,408

(22) Filed: Oct. 30, 2015

(65) Prior Publication Data

US 2016/0227324 A1 Aug. 4, 2016

(30) Foreign Application Priority Data

Feb. 2, 2015 (CN) ..... 2015 2 0072813

(51) Int. Cl.
*H04R 25/00* (2006.01)
*H04R 7/14* (2006.01)
*H04R 1/02* (2006.01)

(52) U.S. Cl.
CPC ..... *H04R 7/14* (2013.01); *H04R 1/021* (2013.01)

(58) Field of Classification Search
CPC ... H04R 1/02; H04R 1/28; H04R 1/08; H04R 1/1075; H04R 1/345; H04R 1/22; H04R 1/2803; H04R 1/2807; H04R 1/2842; H04R 1/288; H04R 1/284; H04R 7/14
USPC ..... 381/345, 346, 347, 350, 348, 349, 351
See application file for complete search history.

(56) References Cited

U.S. PATENT DOCUMENTS

| | | | | |
|---|---|---|---|---|
| 4,005,278 | A * | 1/1977 | Gorike | H04R 5/033 181/137 |
| 5,033,093 | A * | 7/1991 | Tardo | H04R 7/10 181/157 |
| 6,957,714 | B2 * | 10/2005 | Takahashi | H04R 7/20 181/171 |
| 2006/0239494 | A1 * | 10/2006 | Kimura | H04R 9/06 381/386 |
| 2007/0053547 | A1 * | 3/2007 | Ando | H04R 9/06 381/430 |
| 2008/0212808 | A1 * | 9/2008 | Omoda | H04R 7/14 381/191 |
| 2009/0060251 | A1 * | 3/2009 | Maeda | H04R 7/02 381/398 |
| 2011/0194724 | A1 * | 8/2011 | Watanabe | H04R 7/20 381/398 |

(Continued)

*Primary Examiner* — Davetta W Goins
*Assistant Examiner* — Phylesha Dabney
(74) *Attorney, Agent, or Firm* — Na Xu; IPro, PLLC

(57) ABSTRACT

A speaker box with side acoustic emission structure is disclosed. The speaker box has a cabinet having an acoustic window, a speaker unit mounted in the cabinet and including a diaphragm, a voice coil and a magnetic circuit, the diaphragm disposed in the side of the acoustic window and not faced to the acoustic window and having a dome and a suspension surrounding the dome, the dome having a plurality of reinforcements aligned in multi-row, the area of one of the plurality of reinforcements which is closest to the acoustic window that is maximum for improving vibration of the diaphragm.

20 Claims, 3 Drawing Sheets

(56) References Cited

U.S. PATENT DOCUMENTS

| | | | | |
|---|---|---|---|---|
| 2012/0314887 | A1* | 12/2012 | Chen | H04R 9/046 381/162 |
| 2016/0014519 | A1* | 1/2016 | Oclee-Brown | H04R 7/00 381/398 |
| 2016/0119718 | A1* | 4/2016 | Yang | H04R 9/02 381/351 |
| 2016/0205477 | A1* | 7/2016 | Kuribayashi | H04R 1/028 381/334 |
| 2016/0227304 | A1* | 8/2016 | Xu | H04R 1/021 |
| 2016/0227305 | A1* | 8/2016 | Xu | H04R 1/021 |
| 2016/0227313 | A1* | 8/2016 | Cai | H04R 1/2884 |
| 2016/0227314 | A1* | 8/2016 | Cai | H04R 1/2888 |
| 2016/0227321 | A1* | 8/2016 | Xu | H04R 7/125 |
| 2016/0227322 | A1* | 8/2016 | Xu | H04R 7/127 |
| 2016/0227323 | A1* | 8/2016 | Yoon | H04R 7/122 |
| 2016/0227324 | A1* | 8/2016 | Cai | H04R 1/021 |

* cited by examiner

ACOUSTIC DIAPHRAGM AND SPEAKER BOX

RELATED PATENT APPLICATION

This application claims the priority benefit of Chinese patent Application Filing Serial Number CN 201520072813.1, filed on Feb. 2, 2015, the disclosure of which is herein incorporated by reference in its entirely.

FIELD OF THE INVENTION

The present disclosure relates to the art of speakers and, particularly to a speaker box with a side acoustic emission structure for improving the acoustic performance.

DESCRIPTION OF RELATED ART

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones are ubiquitous.

In general, The conventional slim enclosure speaker box with the side acoustic emission structure includes a micro-speaker, a lower case, an upper case, and a cover coupled onto the upper case. The upper case is coupled onto the lower case and includes a sidewalls coupled onto the sidewalls of the lower case, a fixing surface to which a micro-speaker is fixed. At one side of the upper case, the sidewall is partially removed, thus forming an opening which is communicates with the micro-speaker. When the cover is coupled onto the upper case, a space between the cover and the micro-speaker becomes an acoustic passage communicating with the opening for emitting sounds.

Typically, the magnitude of the sound is expressed in dB and represented as a sound pressure level (SPL) or efficiency in a speaker box. This means 'the average magnitude of the sound that can be heard 1 m from the micro-speaker, when an output of 1 w is transferred from an amplifier to the micro-speaker'. Therefore, the greater the sound pressure is, the greater the reproduced sound is with the same output of the amplifier.

As was mentioned above, a slim enclosure speaker box with the side acoustic emission structure, as a line for emitting sounds gets narrower, a sound pressure in low frequencies becomes lower. Specifically, in low frequencies having a relatively large amplitude, an amount of pushing the air increases. As the air passes through such a narrow line, the acoustic resistivity of the one portion of the diaphragm close to the opening is greater than that of the other of the diaphragm far away from the opening. Consequently, the sound pressure imposed on the surface of the diaphragm becomes unbalanced, which degrades low sound characteristics. If an effective area of a sound-emitting hole is reduced to make the enclosure speaker slimmer, the SPL at low sounds is reduced, and some other defaults also occur in the speaker box.

In view of the above-described situation, there exists a need for a technology of making the enclosure speaker slimmer while maximizing the sound-emitting hole in the same size while substantially avoiding or reducing one or more of the above-identified problems.

BRIEF DESCRIPTION OF THE DRAWINGS

Many aspects of the embodiments can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

A speaker box in accordance with an exemplary embodiment of the present disclosure is used for converting audio electrical signals to audible sounds. In general, the speaker box includes a cabinet, and a speaker unit attached to the cabinet. The cabinet has an acoustic hole provided in one sidewall of cabinet for emitting sounds. The speaker unit has a magnetic circuit, a vibrating unit corresponding to the magnetic circuit, and a pair of welding pads for electrically connecting with the vibrating unit for conducting electrical signals to the vibrating unit.

Figure 1:
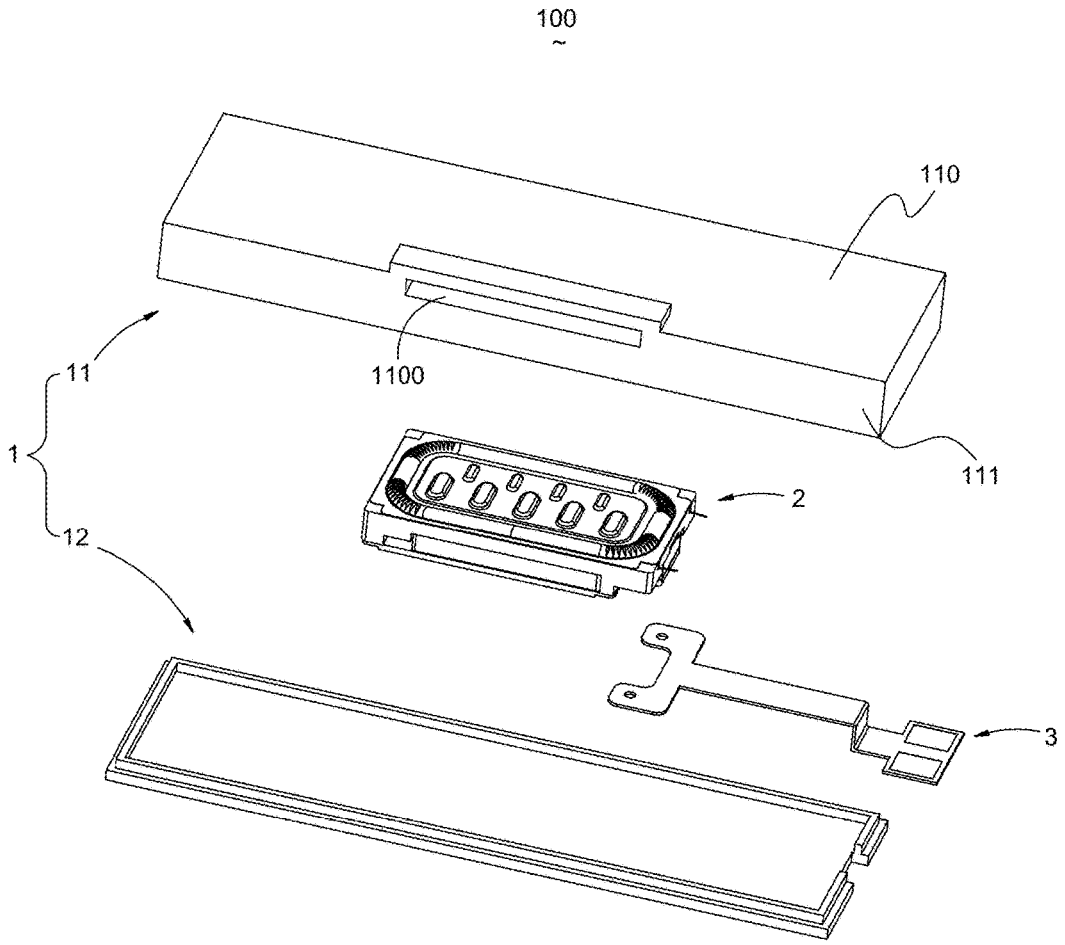
FIG. 1 is an illustrative isometric view of a speaker box in accordance with an exemplary embodiment of the present invention.
Figure 2:
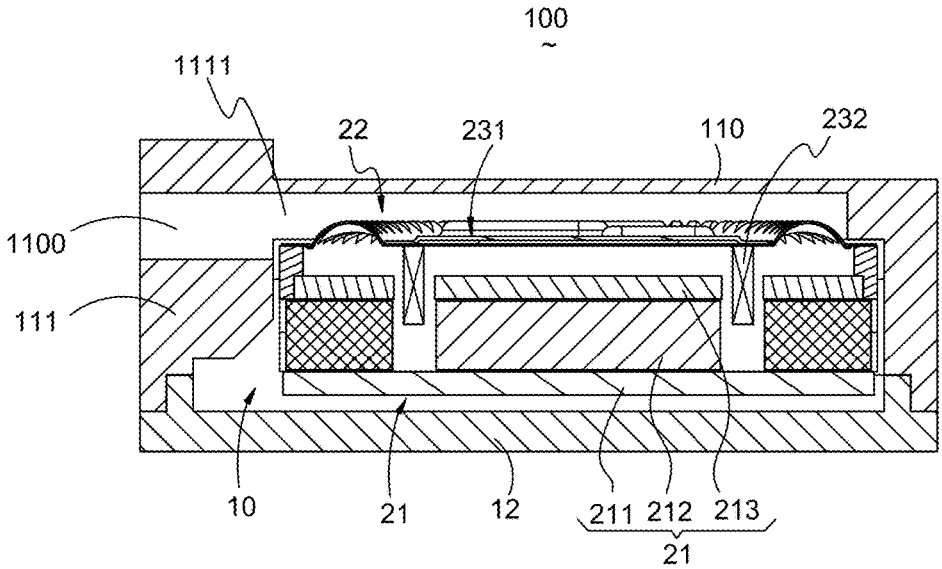
FIG. 2 is a schematic cross-sectional view of the speaker box in accordance with an embodiment of the present invention.

Referring to FIG. 1 and FIG. 2, a speaker box 100 in accordance with an exemplary embodiment of the present disclosure, includes a cabinet 1 defining a case 11, a cover 12 assembled with the case for forming a chamber 10, a speaker unit 2 received in the chamber 10 and a welding pad 3 electrical connected with the speaker unit 2 and extends out of the chamber for electrically connecting to outer circuit.

In the present embodiment, the case 11 which is composed of an injection-molded product and having a bottom wall 110 in shape of rectangle, a sidewall 111 extending upwardly and perpendicularly from the bottom wall 110, and an acoustic window 1100 formed in the sidewall 111 by injection molding technology for communicating with the speaker unit 2 for emitting sounds. Hereby, while the speaker unit 2 is configured in the chamber and faced the bottom wall 110 of the case 11 so as to provide an acoustic device with side acoustic emission structure. The shape of the cabinet 1 is not restricted to rectangle as described in the embodiment. Another type of case 11 is configured to be like a bowel and has a chamber for accommodating the speaker unit 2.

The speaker unit 2 defines a magnetic circuit 21 mounted on the case 11 and a vibrating unit 22 corresponding to the magnetic circuit 21. The magnetic circuit 21 has a yoke 211, a magnet 212 and a pole plate 213 attached to the magnet 212. The vibrating unit 22 comprises a diaphragm 231 and voice coil 232 connected directly or indirectly with the diaphragm 231 and actuated by the magnetic field of the magnetic circuit 21. In the present embodiment, the diaphragm 231 is configured to face the bottom wall 110 of the case 11 so as to form a narrow acoustic passage 1111 which is communicated with the acoustic window 1100. In other words, the narrow acoustic passage 1111 is formed between the diaphragm 231 and the bottom wall 110. While assembled, the diaphragm 231 is able to vibrate along a direction substantially perpendicularly to the bottom wall 110 of the case 11, and sound waves are emitted out from the acoustic window 1100 located in a side of the diaphragm 231.

Figure 3:
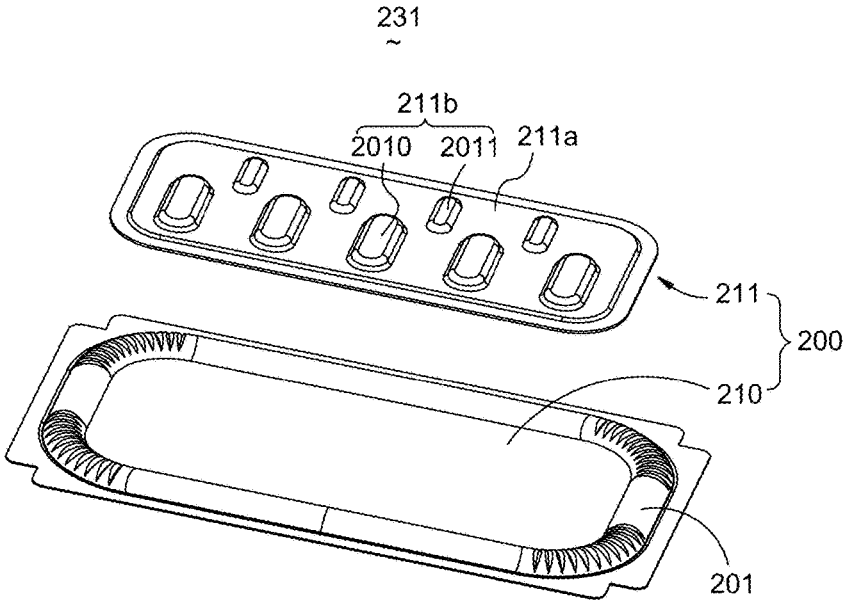
FIG. 3 is an illustrative isometric view of a diaphragm of the speaker box in FIG. 2.
Figure 4:
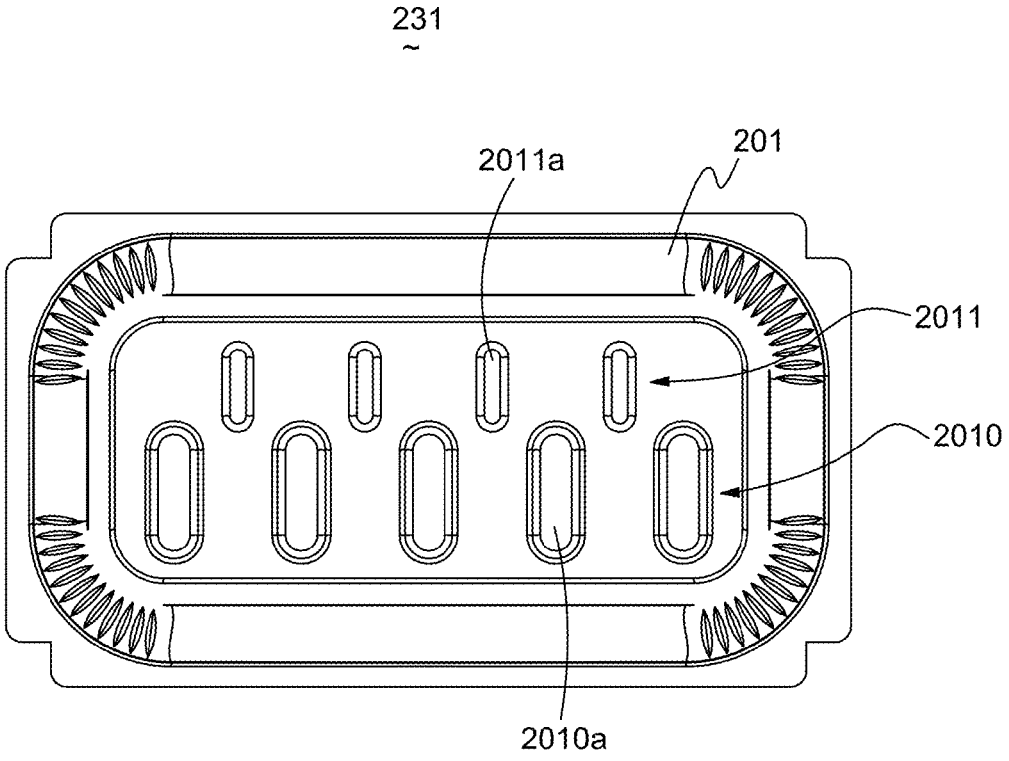
FIG. 4 is a top view of the diaphragm of the speaker box in FIG. 3.

As shown in FIG. 3 and FIG. 4, the diaphragm 21 usually is mounted on the sidewall 111 of the case 11 or the magnet 212, and includes a dome 200 and a suspension 201 surrounding the dome 200. The dome 200 has a flat portion 210 which is integrated with the suspension 201, a reinforced board 211 mounted and sufficient overlapping on the flat portion 210. In the present embodiment, the shape of the diaphragm 231 is not restricted to a rectangle. The diaphragm 231 may be an oval corresponding to magnetic circuit. Furthermore, the reinforced board 211 has a flat plate 211*a* and a plurality of reinforcements 211*b* protruding upwardly or downwardly from the flat plate 211*a* in multi-row. That is to say, the reinforcements 211*b* are designed in the state of being convex or concave so as to adjust vibration of the diaphragm 231.

Especially referring to FIG. 3, the plurality of reinforcements illustrate only two rows of reinforcements. Namely, a first reinforcement 2010 and a second reinforcement 2011, but, the amount of row of the reinforcements are not limited to two, and may be adjusted according to actual requirement. The structure of the first reinforcement 2010 is substantially identical to that of the second reinforcement 2011. Somewhat differently, the area of the first reinforcement 2010 is greater than that of the second reinforcement 2011 in plan view. In the alternative embodiment, the amount of row of the reinforcements may be three rows. Namely that has a first reinforcement, a second reinforcement and a third reinforcement. The second reinforcement is positioned between the first reinforcement and the third reinforcement. The area of the first reinforcement is maximum, and the area of the third reinforcement is minimum. In other words, the area of the plurality of reinforcements aligned in multi-row may be gradually reduced along a direction far away from the acoustic window 1100.

In the present embodiment, the first reinforcement 2010 and the second reinforcement 2011 both are disposed on the reinforced board 211 must not overlap each other along a direction parallel to the diaphragm 231 for improving flexural rigidity of the diaphragm. In other words, each of the first reinforcement 2010 is interlaced with adjacent second reinforcement 2011. The shape of the plurality of reinforcements 211*b* is not restricted to an oval as show in FIG. 4. On the contrary, the shape of the plurality of reinforcements 211*b* may be a rectangle, a hemisphere or a straight bar corresponding to the diaphragm 231.

While assembled, the plurality of reinforcements are disposed below the bottom wall 110 of the case 11. The first reinforcement 2010 is located a proper position which is close to the acoustic window 1110 designed in the sidewall 111 of the case 11, and the second reinforcement 2111 is far away from the acoustic window 1110. That is to say, for adjusting vibration amplitude and rigidity of the diaphragm 231, compared with one of the plurality of reinforcements 211*b* having a minimum area, another of the plurality of reinforcements 211*b* having a maximum area is more close to the acoustic window 1110.

While the present disclosure has been described with reference to the specific embodiments, the description of the disclosure is illustrative and is not to be construed as limiting the disclosure. Various of modifications to the present disclosure can be made to the exemplary embodiments by those skilled in the art without departing from the true spirit and scope of the disclosure as defined by the appended claims.

What is claimed is:

1. A speaker box, comprising:

a case having a bottom wall, a sidewall extending upwardly and perpendicularly form the bottom wall, and an acoustic window formed in the sidewall;

a speaker unit mounted in the case and having a diaphragm positioned below the bottom wall of the case for forming an acoustic passage communicating with the acoustic window, a voice coil, and a magnetic circuit driving the diaphragm to vibrate;

the diaphragm having a dome and a suspension surrounding the dome, the dome having a first reinforcement configured in one row, and a second reinforcement configured in other row paralleled to the first reinforcement, the area of the first reinforcement greater than that of the second reinforcement in plan view.

2. The speaker box as claimed in claim 1, wherein the first reinforcement is close to the acoustic window of the case, and the second reinforcement is far away from the acoustic window of the case.

3. The speaker box as claimed in claim 2, wherein the first reinforcement and the second reinforcement both are designed in the state of being convex or concave.

4. The speaker box as claimed in claim 3, wherein the dome includes a flat portion is integrated with the suspension, a reinforced board attached and substantially coving the flat portion.

5. The speaker box as claimed in claim 4, wherein the first reinforcement and the second reinforcement both are extending and protruding upwardly or downwardly from the reinforced board.

6. The speaker box as claimed in claim 5, wherein the first reinforcement is not overlapped the second reinforcement along a direction parallel to the diaphragm.

7. The speaker box as claimed in claim 6, wherein shapes of the first and second reinforcements are an oval in a planar view.

8. The speaker box as claimed in claim 6, wherein shapes of the first and second reinforcements are a rectangle in a planar view.

9. The speaker box as claimed in claim 6, wherein shapes of the first and second reinforcements are a hemisphere.

10. The speaker box as claimed in claim 6, wherein shapes of the first and second reinforcement are a straight bar.

11. A speaker box, comprising:

a cabinet having an acoustic window with side acoustic emission structure;

a speaker unit mounted in the cabinet and including a diaphragm, a voice coil and a magnetic circuit;

the diaphragm disposed in the side of the acoustic window and not faced to the acoustic window, the diaphragm having a dome and a suspension surrounding the dome, the dome having a plurality of reinforcements aligned in multi-row, the area of one of the plurality of reinforcements which is closest to the acoustic window that is maximum.

12. The speaker box as claimed in claim 11, wherein the area of the plurality of reinforcements aligned in multi-row is gradually reduced along a direction far away from the acoustic window.

13. The speaker box as claimed in claim 12, wherein the plurality of reinforcements is designed in the state of being convex or concave.

14. The speaker box as claimed in claim 13, wherein the dome includes a flat portion is integrated with the suspension, a reinforced board attached and substantially coving the flat portion.

15. The speaker box as claimed in claim 14, wherein the plurality of reinforcements are extending and protruding upwardly or downwardly from the reinforced board.

16. The speaker box as claimed in claim 15, wherein each of the plurality of reinforcements is not overlapped with adjacent reinforcement of another row.

17. The speaker box as claimed in claim 16, wherein the cabinet includes a case and a cover, the case having a bottom wall and a sidewall extending sidewall extending upwardly and perpendicularly form the bottom wall, and the acoustic window formed in the sidewall.

18. The speaker box as claimed in claim 17, wherein the diaphragm is positioned below the bottom wall of the case for forming an acoustic passage for communicating with the acoustic window.

19. The speaker box as claimed in claim 18, wherein the plurality of reinforcements includes a first reinforcement configured in one row, and a second reinforcement configured in other row paralleled to the first reinforcement.

20. The speaker box as claimed in claim 19, wherein shapes of the plurality of reinforcements are an oval or a rectangle or a hemisphere or a straight bar.

* * * * *